United States Patent [19]

Hasegawa et al.

[11] 4,152,144

[45] May 1, 1979

[54] METALLIC GLASSES HAVING A COMBINATION OF HIGH PERMEABILITY, LOW MAGNETOSTRICTION, LOW AC CORE LOSS AND HIGH THERMAL STABILITY

[75] Inventors: Ryusuke Hasegawa, Morristown; Chong-Ping Chou, Mt. Arlington, both of N.J.

[73] Assignee: Allied Chemical Corporation, Morris Township, Morris County, N.J.

[21] Appl. No.: 755,386

[22] Filed: Dec. 29, 1976

[51] Int. Cl.[2] ..... C22C 38/10; C22C 38/12

[52] U.S. Cl. ..... 75/122; 75/123 B; 75/123 D; 75/123 J; 75/123 K; 75/123 M; 75/134 F

[58] Field of Search ..... 75/122, 170, 134 F, 75/123 B, 123 D, 123 J, 123 M, 123 R

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |
| 3,986,867 | 10/1976 | Masumoto et al. | 75/126 A |
| 4,036,638 | 7/1977 | Ray et al. | 148/31.55 |
| 4,038,073 | 7/1977 | O'Hondhey | 75/170 |
| 4,056,411 | 11/1977 | Chen et al. | 75/134 F |
| 4,067,732 | 11/1978 | Ray | 75/128 B |

OTHER PUBLICATIONS

Business Week, 12/1/73, "New Metals in Search of a Use", pp. 64J–65.

*Primary Examiner*—Arthur J. Steiner
*Attorney, Agent, or Firm*—Ernest D. Buff; Gerhard H. Fuchs

[57] ABSTRACT

Metallic glasses having high permeability, low magnetostriction, low ac core loss and high thermal stability are disclosed. In contrast to the prior art in which one, or at most two, of these properties are attained in one metallic glass, all those outstanding properties are achieved in a single metallic glass selected from one of the compositions of the invention. The metallic glasses consist essentially of about 63 to 83 atom percent of at least one metal selected from the group consisting of iron and cobalt, from 0 to about 60% of which metal may be replaced with nickel, about 2 to 12 atom percent of at least one element selected from the group consisting of molybdenum, tungsten, niobium and titanium, and about 15 to 25 atom percent of at least one metalloid element selected from the group consisting of boron, phosphorus and carbon plus incidental impurities.

20 Claims, 2 Drawing Figures

METALLIC GLASSES HAVING A COMBINATION OF HIGH PERMEABILITY, LOW MAGNETOSTRICTION, LOW AC CORE LOSS AND HIGH THERMAL STABILITY

BACKGROUND OF THE INVENTION

1. Field of the Invention

The invention relates to metallic glasses having high permeability, low magnetostriction, low ac core loss and high thermal stability.

2. Description of the Prior Art

As is known, metallic glasses are metastable materials lacking any long range order. X-ray diffraction scans of glassy metal alloys show only a diffuse halo similar to that observed for inorganic oxide glasses.

Metallic glasses (amorphous metal alloys) have been disclosed in U.S. Pat. No. 3,856,513, issued Dec. 24, 1974 to H. S. Chen et al. These alloys include compositions having the formula $M_aY_bZ_c$, where M is a metal selected from the group consisting of iron, nickel, cobalt, vanadium and chromium, Y is an element selected from the group consisting of phosphorus, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are metallic glassy wires having the formula $T_iX_j$, where T is at least one transition metal and X is an element selected from the group consisting of phosphorus, boron, carbon, aluminum, silicon, tin, germanium, indium, beryllium and antimony, "i" ranges from about 70 to 87 atom percent and "j" ranges from about 13 to 30 atom percent. Such materials are conveniently prepared by rapid quenching from the melt using processing techniques that are now well-known in the art.

Metallic glasses are also disclosed in application Ser. No. 590,532, filed June 26, 1975. These glassy alloys include compositions having the formula $M_aM'_bCr_cM''_dB_e$, where M is one iron group element (iron, cobalt and nickel) M' is at least one of the two remaining iron group elements, M'' is at least one element of vanadium, manganese, molybdenum, tungsten, niobium and tantalum, B is boron, "a" ranges from about 40 to 85 atom percent, "b" ranges from 0 to about 45 atom percent, "c" and "d" both range from 0 to about 20 atom percent and "e" ranges from about 15 to 25 atom percent, with the proviso that "b", "c" and "d" cannot be zero simultaneously. Such glassy alloys are disclosed as having an unexpected combination of improved ultimate tensile strength, improved hardness and improved thermal stability.

These disclosures also mention unusual or unique magnetic properties for many metallic glasses which fall within the scope of the broad claims. However, metallic glasses possessing a combination of higher permeability, lower magnetostriction, lower core loss and higher thermal stability than prior art metallic glasses are required for specific applications such as tape recorder heads, relay cores, transformers and the like.

SUMMARY OF THE INVENTION

In accordance with the invention, metallic glasses having a combination of high permeability, low magnetostriction, low ac core loss and high thermal stability are provided. The metallic glasses consist essentially of about 63 to 83 atom percent of at least one metal selected from the group consisting of iron and cobalt, from 0 to about 60% of which metal may be replaced with nickel, about 2 to 12 atom percent of at least one element selected from the group consisting of molybdenum, tungsten, niobium and titanium and about 15 to 25 atom percent of at least one metalloid element selected from the group consisting of boron, phosphorus and carbon plus incidental impurities. The metallic glasses of the invention are suitable for use in tape recorder heads, relay cores, transformers and the like.

DETAILED DESCRIPTION OF THE INVENTION

The metallic glasses of the invention are characterized by a combination of high permeability, low saturation magnetostriction, low ac core loss and high thermal stability. The glassy alloys of the invention consist essentially of about 63 to 83 atom percent of at least one metal selected from the group consisting iron and cobalt, about 2 to 12 atom percent of at least one element selected from the group consisting of molybdenum, tungsten, niobium, titanium and about 15 to 25 atom percent of at least one element selected from the group consisting of boron, phosphorus and carbon plus incidental impurities. A concentration of less than about 2 atom percent of Mo, W, Nb and/or Ti does not result in a sufficient improvement of the properties of permeability, saturation magnetostriction, ac core loss and thermal stability. A concentration of greater than about 12 atom percent of at least one of these elements results in an unacceptably low Curie temperature.

Iron provides high saturation magnetization at room temperature. Accordingly the metal content is preferably substantially, iron, with up to about 10 atom percent cobalt in order to compensate the reduction of the room temperature saturation magnetization due to the presence of molybdenum, tungsten, niobium and/or titanium.

Up to about 60% of the iron and/or cobalt may be replaced by nickel in order to further increase permeability. The presence of nickel also minimizes reduction of magnetization with temperature which is caused by the presence of Mo, W, Nb and/or Ti.

Examples of metallic glasses of the invention include $Fe_{78}Mo_2B_{20}$, $Fe_{76}Mo_4B_{20}$, $Fe_{40}Ni_{36}Mo_4B_{20}$, $Fe_{70}Co_6Mo_4C_{18}B_2$, $Fe_{72}Mo_8C_{18}B_2$, $Fe_{70}Ni_6Mo_4C_{18}B_2$ and $Fe_{81}Mo_2B_{17}$ (the subscripts are in atom percent). The purity of all alloys is that found in normal commercial practice.

Figure 1:
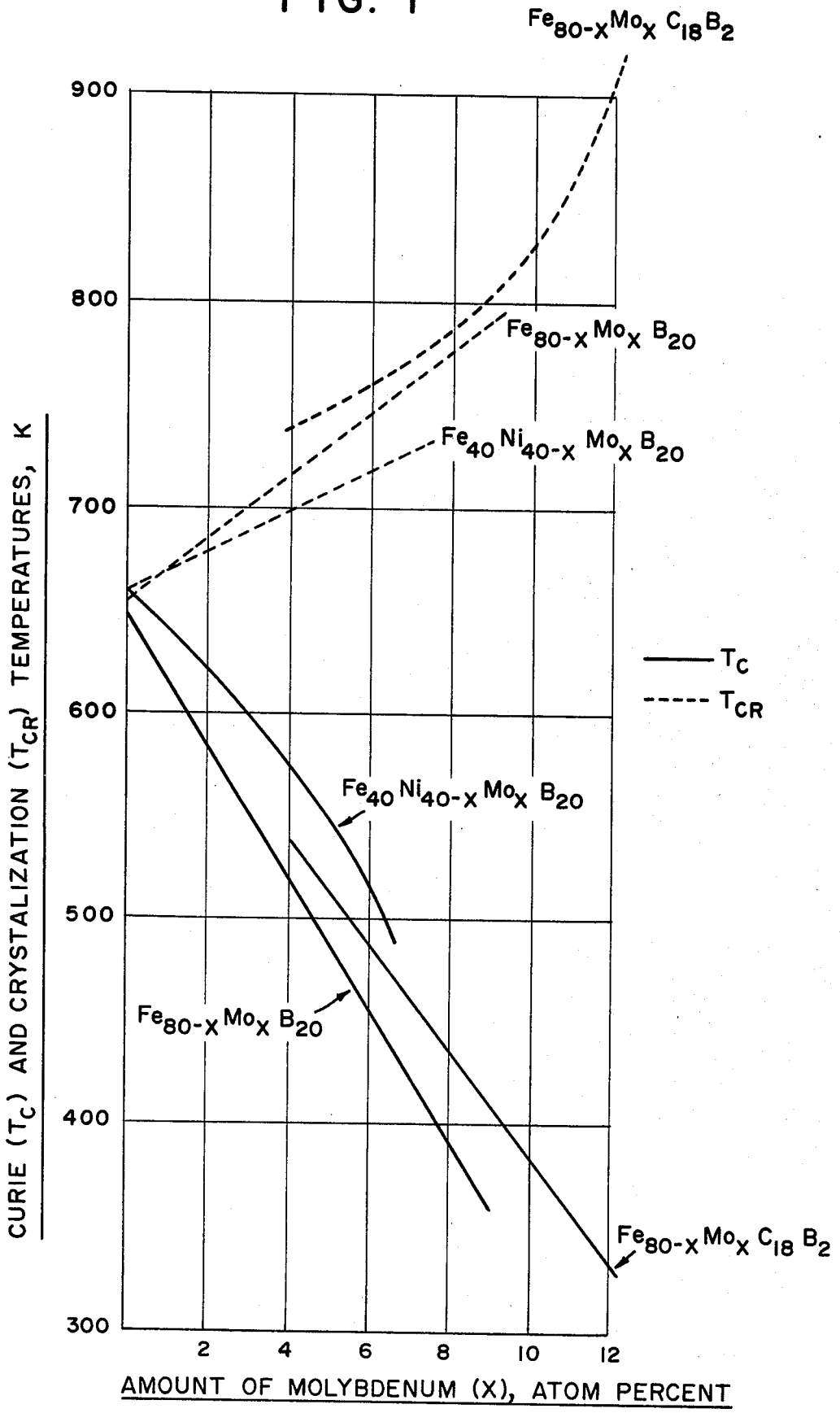
FIG. 1, on coordinates of temperature in K and atom percent of Mo, depicts the effect of molybdenum concentration in metallic glasses of the invention on Curie temperature and crystallization temperature.

Unexpectedly, the presence of molybdenum (and/or tungsten, niobium and titanium) raises the crystallization temperature while simultaneously lowering the Curie temperature of the glassy alloy. Such an effect is depicted in FIG. 1, which is a plot of the crystallization and Curie temperatures as a function of Mo concentration for metallic glasses having the compositions $Fe_{80-x}Mo_xB_{20}$, $Fe_{80-x}Mo_xC_{18}B_2$ and $Fe_{40}Ni_{40-x}Mo_xB_{20}$. The increased separation of these temperatures provides ease of magnetic annealing, that is, thermal annealing at a temperature just above the Curie temperature in a magnetic field. As is well-known, annealing a magnetic material just above its Curie temperature generally results in improved properties. As a consequence of the increase in crystallization temperature with increase in molybdenum concentration, annealing can be easily done at elevated temperatures above the Curie temperature and below the crystallization temperature. Such annealing cannot be carried out for many alloys similar to those of the invention but lacking molybdenum. On the other hand, too high a concentration of molybdenum (and/or tungsten, niobium and titanium) reduces the Curie temperature to a level that may be undesirable in certain applications. For metallic glasses in which boron is the major metalloid constituent, a preferred range of molybdenum concentration is about 2 to 6 atom percent. For metallic glasses in which carbon is the major metalloid constituent, a preferred range of molybdenum concentration is about 4 to 8 atom percent. For the latter alloys, the presence of less than about 4 atom percent of molybdenum results in formation of partially crystalline material having low ductility. Indeed, carbon-containing glassy alloys cannot be easily formed at all unless some molybdenum is present.

It is preferred that the metalloid content consist essentially of substantially boron only, of substantially phosphorus only and of carbon plus boron, since combinations of phosphorus and carbon tend to lead to high stress corrosion and combinations of boron and phosphorus typically evidence low thermal stability. Preferably, the metalloid content ranges from about 17 to 20 atom percent for maximum thermal stability.

Preferred metallic glass systems are as follows:

1. Fe-Mo-B: $Fe_{80-x}Mo_xB_{20}$, where "x" ranges from about 2 to 10 atom percent. These metallic glasses have a combination of high saturation magnetizations, low core losses, high permeabilities and high resistivities (about 160 to 190 $\mu\Omega-cm$).

2. Fe-Ni-Mo-B: $Fe_{40}Ni_{40-x}Mo_xB_{20}$, where "x" ranges from about 2 to 12 atom percent. These metallic glasses, when heat treated, have high initial permeabilities (about 17,000) and high maximum permeabilities (about 500,000). The effective permeability $\mu_e$ of, for example, a heat-treated $Fe_{40}Ni_{36}Mo_4B_{20}$ metallic glass is about 1000 at 1 MHz, in contrast to $\mu_e$ of about 80 for a heat-treated $Fe_{40}Ni_{40}B_{20}$ metallic glass. These high permeabilities, combined with low core loss and low magnetostriction (about 8 ppm) are especially suited for tape-head applications.

3. Fe-Mo-C-B: $Fe_{80-x}Mo_xC_{18}B_2$, where "x" ranges from about 4 to 12 atom percent. These metallic glasses have saturation magnetizations somewhat higher than those of Fe-Mo-B glassy alloys, about the same ac core losses, and low magnetostriction, approaching zero for $x=12$.

4. Fe-Ni-Mo-C-B: $Fe_{76-y}Ni_yMo_4C_{18}B_2$, where "y" ranges from 0 to about 9 atom percent. These metallic glasses have low core losses at high frequencies (loss $\propto f^{1.2}$) and low frequency dependence of coercivity ($H_c \propto F^{0.25}$). With a remanence of about 4.7 kGauss and a saturation magnetization of about 12 kGauss for $x=9$, these metallic glasses are suitable as tape-head cores.

Permeability is the ratio of induction to applied magnetic field. A higher permeability renders a material more useful in certain applications such as tape recorder heads due to the increased response. Permeability is usually discussed in terms of two types - initial permeability, usually at an applied field generating 50 Gauss, and maximum permeability. Prior art metallic glasses evidence initial permeabilities of less than about 2,500 and maximum permeabilities of less than about 70,000 in the as-quenched state, as do metallic glasses without the presence of molybdenum. For example, a prior art metallic glasses having the composition $Fe_{80}B_{20}$ has an initial permeability of 2,500 and a maximum permeability of 60,000. In contrast, a metallic glass of the invention having the composition $Fe_{76}Mo_4B_{20}$ has an initial permeability of 4,600 and a maximum permeability of 128,000. These values are about twice those of the prior art metallic glasses.

The frequency dependence of effective permeability of the glassy alloys of the invention is similar to that of the 4–79 Permalloys, and at higher frequencies (about 50 kHz to 1 MHz), the effective permeability is nearly twice that of the 4–79 Permalloys. Especially noted is the fact that a heat-treated $Fe_{40}Ni_{36}Mo_4B_{20}$ metallic glass has about 10 times higher effective permeability than the best heat-treated $Fe_{40}Ni_{40}B_{20}$ metallic glass over the foregoing frequency range.

Saturation magnetostriction is the change in length under the influence of a saturating magnetic field. A lower saturation magnetostriction renders a material more useful in certain application such as tape recorder heads. Magnetostriction is usually discussed in terms of the ratio of the change in length to the original length, and is given in ppm. Prior art metallic glasses evidence saturation magnetostrictions of 10 to 30 ppm and higher, as do metallic glasses without the presence of molybdenum. For example, a prior art metallic glass having the composition $Fe_{40}Ni_{40}P_{14}B_6$ has a saturation magnetostriction of 11 ppm. In contrast, a metallic glass of the invention having the composition $Fe_{40}Ni_{34}Mo_6B_{20}$ has a saturation magnetostriction of 5 ppm. Similarly, a prior art metallic glass alloy having the composition $Fe_{80}B_{20}$ has a saturation magnetostriction of 30 ppm. In contrast, a metallic glass of the invention having the composition $Fe_{76}Mo_4B_{20}$ has a saturation magnetostriction of 16 ppm. In each case, addition of molybdenum reduces the saturation magnetostriction by about 50%.

Ac core loss is that energy loss dissipated as heat. It is the hysteresis in an ac field and is measured by the area of a B-H loop for low frequencies (less than about 1 kHz) and from the complex imput power in the exciting coil for high frequencies (about 1 kHz to 1 MHz). A lower core loss renders a material more useful in certain applications such as tape recorder heads and transformers. Core loss is discussed in units of watts/kg. Prior art metallic glasses typically evidence ac core losses of at least about 0.5 to 7 watts/kg at an induction of 1 kGauss over the frequency range of 1 to 5 kHz, as do metallic glasses without the presence of molybdenum. For example, a prior art metallic glass having the composition $Fe_{40}Ni_{40}P_{14}B_6$, has an ac core loss of 0.5 to 7 watts/kg at an induction of 1 kGauss over the frequency range of 1 to 5 kHz, while a metallic glass having the composition $Fe_{80}B_{20}$ has an ac core loss of 0.4 to 3.5 watts/kg at an induction of 1 kGauss over the same frequency range. In contrast, a metallic glass alloy of the invention having the composition $Fe_{40}Ni_{36}Mo_4B_{20}$ has an ac core loss of 0.3 to 2.7 watts/kg at an induction of 1 kGauss over the same frequency range.

Figure 2:
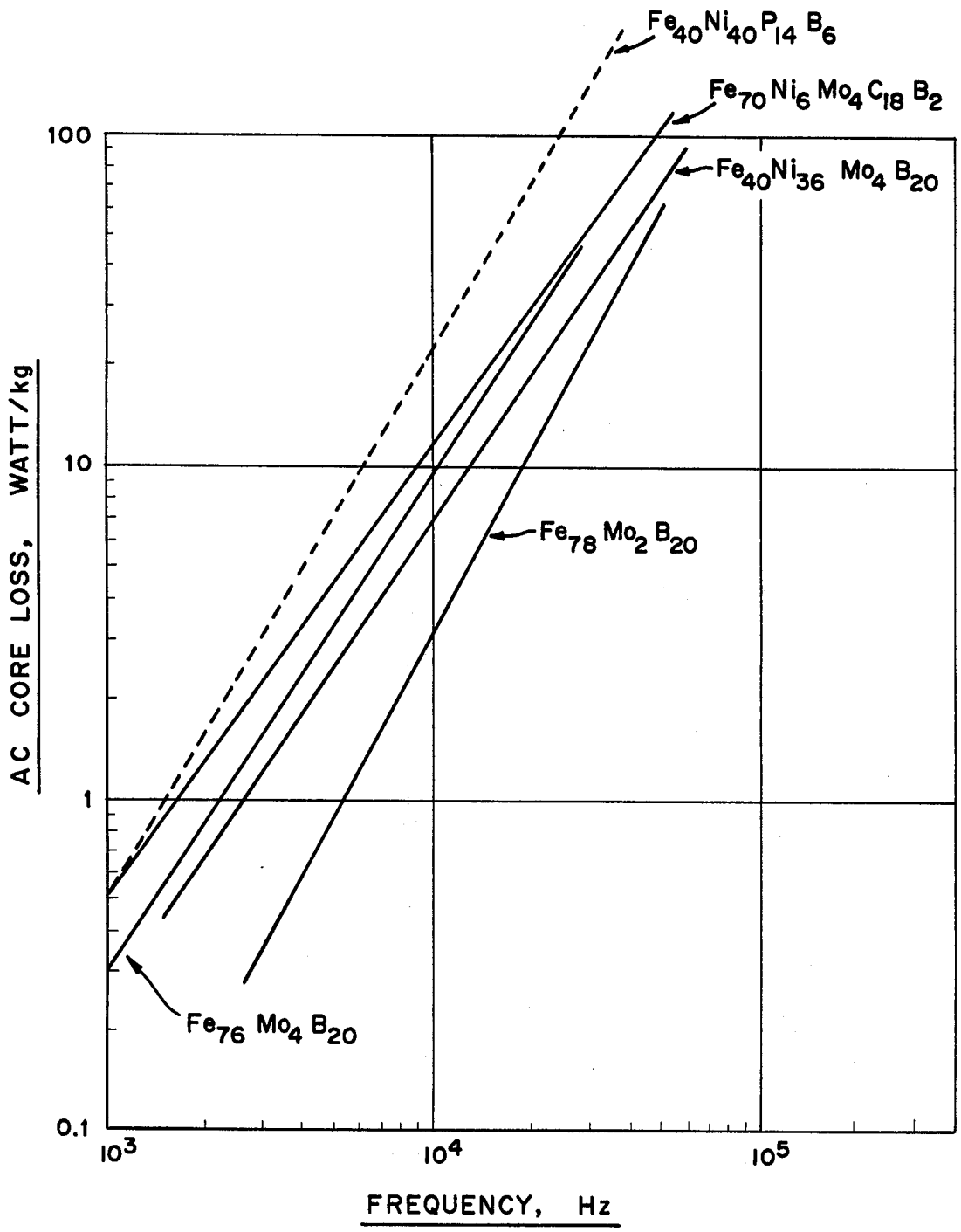
FIG. 2, on coordinates of core loss in watt/kg and frequency in Hz, depicts core loss as a function of frequency for as-quenched metallic glasses of the invention compared with a prior art as-quenched metallic glass.

FIG. 2 depicts the frequency dependence of core loss for several metallic glasses of the invention ($Fe_{40}Ni_{36}$-

$Mo_4B_{20}Fe_{70}Ni_6Mo_4C_{18}B_2$, $Fe_{76}Mo_4B_{20}$ and $Fe_{78}Mo_2B_{20}$), compared with a prior art metallic glass ($Fe_{40}Ni_{40}P_{14}B_6$). The carbon-containing metallic glasses of the invention have somewhat better ac properties at higher frequencies than glassy $Fe_{40}Ni_{40}P_{14}B_6$, while the boron-containing metallic glasses of the invention evidence a core loss about 1/10 that of the prior art metallic glass. Annealing further reduces the core loss of the metallic glasses of the invention over that of prior art alloys.

Crystallization temperature is the temperature at which a metallic glass begins to crystallize. A higher crystallization temperature renders a material more useful in high temperature applications and, in conjunction with a Curie temperature that is substantially lower than the crystallization temperature, permits magnetic annealing just above the Curie temperature. The crystallization temperature as discussed herein is measured by thermomagnetization techniques and gives somewhat more accurate results than crystallization temperatures measured by differential scanning calorimeters. Prior art glassy alloys evidence crystallization temperatures of about 660 K as do metallic glasses without the addition of molybdenum. For example, a metallic glass having the composition $Fe_{40}Ni_{40}P_{14}B_6$ has a crystallization temperature of 665 K, while a metallic glass having the composition $Fe_{80}B_{20}$ has a crystallization temperature of 658 K. In contrast, a metallic glass of the invention having the composition $Fe_{80-x}Mo_xB_{20}(0<x\leqq 8)$ evidences an increase in crystallization temperature of about 15° per atom percent of molybdenum present; see also FIG. 1.

In summary, the metallic glasses of the invention have a combination of high permeability, low saturation magnetostriction, low ac core loss and high crystallization temperature and are useful as tape heads, relay cores, transformers and the like.

The metallic glasses of the invention are prepared by cooling a melt of the desired composition at a rate of at least about $10^{5}$° C./sec, employing quenching techniques well known to the metallic glass art; see e.g., U.S. Pat. No. 3,856,513. The metallic glasses are substantially completely glassy, that is, at least 90% glassy, and consequently possess lower coercivities and are more ductile than less glassy alloys.

A variety of techniques are available for fabricating continuous ribbon, wire, sheet, etc. Typically, a particular composition is selected, powders or granules of the requisite elements in the desired portions are melted and homogenized and the molten alloy is rapidly quenched on a chill surface such as a rapidly rotating cylinder.

EXAMPLES

Example 1: Fe-Mo-B System

Ribbons having compositions given by $Fe_{80-x}Mo_xB_{20}$ and having dimensions about 1 to 2 mm wide and about 30 to 50 μm thick were formed by squirting a melt of the particular composition by overpressure of argon onto a rapidly rotating copper chill wheel (surface speed about 3000 to 6000 ft/min).

Molybdenum content was varied from 2 to 15 atom percent. Substantially glassy ribbons were obtained for a molybdenum content up to about 10 atom percent. Higher molybdenum content reduced the Curie temperature to an unacceptably low value.

Permeability, magnetostriction, core loss, magnetization and coercive force were measured by conventional techniques employing B-H loops, semiconductor strain gauges and a vibrating sample magnetometer. Curie temperature and crystallization temperature were measured by a thermomagnetization technique. The data are summarized in Table I below. Included for comparison are data of a metallic glass containing no molybdenum ($Fe_{80}B_{20}$). The magnetic properties of these glassy alloys after annealing are presented in Table II.

The presence of molybdenum is seen to increase the dc permeability and the resistivity and to lower the ac core loss, coercivity and magnetostriction both in the as-quenched and heat-treated states. In addition, the effective ac permeabilities at 500 KHz were about 1200 for heat-treated $Fe_{78}Mo_2B_{20}$ and $Fe_{76}Mo_4B_{20}$ metallic glasses. The combination of these properties make these compositions suitable for high frequency transformer and tape-head applications.

TABLE I

Magnetic and Thermal Properties of $Fe_{80-x}Mo_xB_{20}$, As-quenched

| Value of "x" | dc Permeability Initial (50) | dc Permeability Maximum | Saturation Magnetostriction, ppm | ac Core Loss*, watts/kG | Saturation Magnetization, kGauss | Remanence, kGauss | Coercive Force Oe | Curie Temp, K. | Crystallization Temp, K. | Room Temperature Resistivity, μΩ−cm |
|---|---|---|---|---|---|---|---|---|---|---|
| 1 | 2,500 | 60,000 | 30 | 3.5 | 16.0 | 7.5 | 0.100 | 647 | 658 | 140 |
| 2 | 2,180 | 72,000 | 20 | 2.5 | 13.4 | 5.5 | 0.076 | 595 | 680 | 160 |
| | 2,470 | 63,500 | | 0.9 | | 5 0 | 0.078 | | | |
| 4 | 4,600 | 128,000 | 16 | 3.5 | 10.9 | 4.9 | 0.038 | 520 | 720 | 166 |
| | 4,600 | 128,000 | | | | 4.9 | 0.038 | | | |
| 6 | — | — | 10 | — | 8.9 | — | — | 456 | 750 | 165 |
| 8 | — | — | 7 | — | 6.6 | — | — | 395 | 775 | 190 |
| 10 | — | — | — | — | — | — | — | — | — | 162 |
| 12 | — | — | — | — | — | — | — | — | — | 151 |

*At an induction of 1kGauss and a frequency of 5kHz.

TABLE II

Magnetic Properties of $Fe_{80-x}Mo_xB_{20}$, Annealed

| Value of "x" | dc Permeability initial (50) | dc Permeability Maximum | ac Core Loss* watt/kg | Remanence, kGauss | Coercive Force, Oe |
|---|---|---|---|---|---|
| 0 | (a) 6,500 | 320,000 | 1.1 | 12 | 0.04 |
| 2 | (b) 14,300 | 375,000 | 0.8 | 7.5 | 0.020 |
| | (c) 11,200 | 347,000 | | 7.6 | 0.022 |
| 4 | (d) 10,700 | 280,000 | 0.7 | 4.75 | 0.017 |

TABLE II-continued

| Magnetic Properties of $Fe_{80-x}Mo_xB_{20}$, Annealed | | | | | |
|---|---|---|---|---|---|
| Value of "x" | dc Permeability initial (50) | Maximum | ac Core Loss* watt/kg | Remanence, kGauss | Coercive Force, Oe |
| (e) | 9,500 | 221,000 | | 3.75 | 0.017 |

*At an induction of 1 kGauss and a frequency of 5 kHz.
(a) Heated to 600° K. for 1 hr and cooled to 300° K. at 50°/hr.
(b) Heated to 673° K., cooled to 620° K., cooled to 298° K. at 50°/hr in 10 Oe.
(c) Heated to 700° K., cooled to 620° K., cooled to 298° K. at 50°/hr in 10 Oe.
(d) Heated to 663° K., cooled to 550° K., cooled to 530° K. at 13°/hr in 10 Oe, cooled to 298° K.
(e) Heated to 660° K., cooled to 298° K. at 150°/hr in 10 Oe.

Example 2: Fe-Ni-Mo-B System Ribbons having compositions given by $Fe_{40}Ni_{40-x}Mo_xB_{20}$ and having dimensions about 1 to 2 mm wide and about 25 to 50 μm thick were formed as in Example 1.

Molybdenum content was varied from 2 to 15 atom percent. Substantially glassy ribbons were obtained for molybdenum content up to about 12 atom percent. Higher molybdenum content reduced the Curie temperature to an unacceptably low value.

The magnetic and thermal data are summarized in Table III below. Included for comparison are data of a metallic glass containing no molybdenum ($Fe_{40}Ni_{40}B_{20}$). The magnetic properties of these glassy alloys after annealing are presented in Table IV.

Low field magnetic properties of as-quenched metallic glasses with and without molybdenum were comparable except for the reduction of the magnetostriction, the increase in resistivity and the increase in crystallization temperature in the metallic glasses containing molybdenum. Due to the decrease in the Curie temperature, shown in FIG. 1, the metallic glasses suited for effective field annealing are limited to the alloys containing up to about 6 atom percent of molybdenum. Although the dc permeabilities of the molybdenum-containing annealed glassy alloys were somewhat lower than those of the molybdenum-free annealed $Fe_{40}Ni_{40}B_{20}$ alloy (Table IV), effective ac permeabilities of the annealed $Fe_{40}Ni_{40-x}Mo_xB_{20}$ glassy alloys ($x \geqq 2$) became comparable at about 60 Hz with those of annealed $Fe_{40}Ni_{40}B_{20}$. In contrast to the drastic reduction of the ac permeability of the annealed $Fe_{40}Ni_{40}B_{20}$ glassy alloys above 60 Hz, the molybdenum-containing metallic glasses of the invention did not suffer from such a drastic reduction. For example, the ac permeability of heat-treated $Fe_{40}Ni_{36}Mo_4B_{20}$ metallic glass was about 8500, 5500 and 1800 at frequencies of 50 kHz, 100 kHz and 500 kHz, respectively. These values were, respectively, 600, 350 and 110 for the best heat-treated $Fe_{40}Ni_{40}B_{20}$ metallic glass.

Further, a considerable reduction of ac core loss was achieved in the annealed, molybdenum-containing metallic glasses of the invention (see Table IV). The core loss ranged from about 1/10 to 1/20 that of annealed, molybdenum-free metallic glasses.

The foregoing improved combination of properties of the metallic glasses of the invention render these compositions suitable in tape recording head applications.

TABLE III

| Magnetic and Thermal Properties of $Fe_{40}Ni_{40-x}Mo_xB_{20}$, As-quenched | | | | | | | | | | |
|---|---|---|---|---|---|---|---|---|---|---|
| Value of "x" | dc Permeability Initial (50) | Maximum | Saturation Magneto-striction, ppm | ac Core Loss* watts/kG | Saturation Magneti-zation, kGauss | Remanence, kGauss | Coercive Force, Oe | Curie Temp, K. | Crystal-lization Temp, K. | Room Temperature Resistivity, μΩ −cm |
| 0 | 3,600 | 60,000 | 13.5 | 3.5 | 10.0 | 5.0 | 0.06 | 662 | 662 | 140 |
| 2 | 2,470 | 47,600 | 10 | 2.7 | 9.1 | 3.0 | 0.063 | 625 | 680 | 170 |
| | 3,000 | 72,000 | | | | 4.1 | 0.057 | | | |
| 4 | 3,260 | 61,000 | 8 | 2.7 | 8.2 | 3.4 | 0.056 | 576 | 700 | 160 |
| | 3,600 | 74,000 | | | | 3.9 | 0.053 | | | |
| 6 | 2,060 | 30,700 | 5 | 4.2 | 6.7 | 2.3 | 0.075 | 514 | 720 | 150 |

*At an induction of 1 kGauss and a freuqency of 5 kHz.

TABLE IV

| Magnetic Properties of $Fe_{40}Ni_{40-x}Mo_xB_{20}$, Annealed | | | | | |
|---|---|---|---|---|---|
| Value of "x" | dc Permeability Initial (50) | Maximum | ac Core Loss* watt/kg | Remanence, kGauss | Coercive Force, Oe |
| 0 (a) | 30,000 | 800,000 | 9.5 | 8.5 | 0.015 |
| 2 (b) | 14,130 | 485,000 | 1.4 | 8.3 | 0.017 |
| (c) | 8,330 | 406,300 | | 8.1 | 0.020 |
| 4 (d) | 17,000 | 300,000 | 0.7 | 6.0 | 0.020 |
| (e) | 12,300 | 500,000 | | 7.5 | 0.015 |
| 6 (f) | 14,250 | 174,000 | 0.45 | 3.8 | 0.020 |

*At an induction of 1 kGauss and a freqency of 5 kHz.
(a) Heated to 660 K., cooled to 300 K. at 50°/hr in 10 Oe.
(b) Heated to 670 K., cooled to 600 K., held at 600 K. for 20 min, cooled to 298 K. at 50°/hr in Oe.
(c) Heated to 670 K., cooled to 298 K. at 100°/hr in 10 Oe.
(d) Heated to 680 K., cooled to 625 K., cooled to 298 K. at 50°/hr in 10 Oe.
(e) Heated to 680 K., cooled to 298 K. at 100°/hr in 10 Oe.
(f) Heated to 515 K., cooled to 500 K. at 10°/hr, cooled to 300 K. at 50°/hr in 10 Oe.

Example 3: Fe-Mo-C-B System

Ribbons having compositions given by $Fe_{80-x}Mo_xC_{18}B_2$ and having dimensions about 1 to 2 mm wide and about 25 to 50 μm thick were formed as in Example 1. Molybdenum content was varied from 2 to 15 atom percent. Substantially glassy ribbons were contained from molybdenum content from 4 to 12 atom percent.

Molybdenum content less than 4 atom percent formed substantially crystalline ribbons which were quite brittle. Molybdenum content greater than about 12 atom percent reduced the Curie temperature to an unacceptably low value.

The magnetic and thermal data are summarized in Table V below. The magnetic properties of these metallic glasses after annealing are presented in Table VI. The corresponding alloy without molybdenum could not be quenched to a substantially glassy state.

As seen in Table V, the as-quenched metallic glass $Fe_{72}Mo_8C_{18}B_2$ had initial permeability $\mu_{50}$ of about 5500. This is the highest value observed so far among as-quenched metallic glasses. This compares quite favorably with the as-quenched $Fe_{40}Ni_{40}P_{14}B_6$ metallic glass, for which $\mu_{50}=1600$ and which has about the same room temperature saturation induction as the above mentioned glassy alloy. Further, the core loss at 5 kHz of the molybdenum-containing metallic glass (x=8) was about 1/5 that of $Fe_{40}Ni_{40}P_{14}B_6$.

The metallic glasses of the invention thus provide nickel-free materials having properties comparable to those metallic glasses containing high amounts of nickel, such as $Fe_{40}Ni_{40}P_{14}B_6$.

Example 4: Fe-N-Mo-C-B System

Ribbons having compositions given by $Fe_{76-y}Ni_yMo_4C_{18}B_2$ and having dimensions of about 1 to 2 mm wide and about 25 to 50 μm thick were formed as in Example 1. Nickel content was varied from 0 ($Fe_{76}Mo_4C_{18}B_2$) to 9 atom percent. The magnetic and thermal data are summarized in Table VII below. The magnetic properties of these metallic glasses after annealing are presented in Table VIII.

Nickel was added to Fe-Mo-C-B alloys in an attempt to compensate the decrease in Curie temperature due to the presence of molybdenum. However, the following unexpected results were also obtained: the frequency dependence of the coercivity and ac core losses of glassy compositions of this system were considerably lower than those of other systems. Most metallic glasses evidence $H_c \propto f^{0.4}$ and losses $\propto F^{1.4}$ at high frequencies, while the glassy alloys of this system evidence $H_c \propto f^{0.25}$ and losses $\propto f^{1.2}$ at high frequencies (see FIG. 2). Up to about 100 Hz, the coercivity of glassy compositions of this system was either constant or had a small frequency dependence ($H_c \propto f^{0.1}$). In contrast, the coercivity of other glassy alloys starts to increase at f=1 to 10 Hz, obeying the $f^{0.4}$ law. Thus, the glassy compositions of this system evidence a better high frequency performance and are thus suitable for high frequency magnetic devices.

TABLE V

Magnetic and Thermal Properties of $Fe_{80-x}Mo_xC_{18}B_2$, As-quenched

| Value of "x" | dc Permeability Initial (50) | dc Permeability Maximum | Saturation Magnetostriction, ppm | ac Core Loss*, watt/kg | Saturation Magnetization, kGauss | Remanence, kGauss | Coercive Force, Oe | Curie Temp, K. | Crystallization Temp, K. |
|---|---|---|---|---|---|---|---|---|---|
| 4 | 1,100 | 58,000 | 18 | 4.0 | 12.5 | 4.4 | 0.08 | 539 | 740 |
| 6 | 1,550 | 50,000 | 14 | 2.4 | 10.5 | 3.85 | 0.07 | 485 | 758 |
| 8 | 5,500 | 71,000 | 8 | 1.5 | 8.9 | 3.3 | 0.04 | 416 | 790 |
| 10 | — | — | 5 | — | 6.5 | 2.7 | 0.035 | 396 | 830 |
| 12 | — | — | 2 | — | 4.1 | 1.0 | 0.02 | 335 | 906 |

At an induction of 1 kGauss and a frequency of 5 kHz.

TABLE VI

Magnetic Properties of $Fe_{80-x}Mo_xC_{18}B_2$, Annealed

| Value of "x" | dc Permeability Initial (50) | dc Permeability Maximum | Saturation Magnetization, kGauss | Remanence, kGauss | Coercive Force, Oe |
|---|---|---|---|---|---|
| 4 (a) | 3,140 | 114,000 | 12.5 | 5.25 | 0.046 |
| 6 (b) | 3,010 | 129,000 | 10.5 | 4.25 | 0.033 |
| 8 (c) | 3,200; 5,000 | 90,000 | 8.9 | 3.0; 3.25 | 0.042; 0.036 |
| (d) | 4,750 | 96,000 | | 2.68 | 0.028 |
| (e) | 3,800 | 120,000 | | 3.48 | 0.029 |
| 10 | — | — | 6.5 | — | — |
| 2 | — | — | 4.1 | — | — |

(a) Heated to 623 K., held 2 hrs, cooled to 298 K.
(b) Heated to 598 K., held 3 hrs, cooled to 298 K.
(c) Heated to 500 K., cooled to 298 K. at 1°/min in 10 Oe.
(d) Heated to 630 K., cooled to 298 K. at 1°/min in 10 Oe.
(e) Heated to 630 K., cooled to 298 K. at 7°/min in 10 Oe.

TABLE VII

Magnetic and Thermal Properties of $Fe_{76-y}Ni_yMo_4C_{18}B_2$, As-quenched

| Value of "y" | dc Permeability Initial (50) | dc Permeability Maximum | Saturation Magnetostriction ppm | ac Core Loss*, watt/kg | Saturation Magnetization, kGauss | Remanence, kGauss | Coercive Force, Oe | Curie Temp, K. | Crystallization Temp, K. |
|---|---|---|---|---|---|---|---|---|---|
| 0 | 1,100 | 58,000 | 18 | 4.0 | 12.5 | 4.4 | 0.08 | 539 | 740 |
| 3 | 1,240 | 63,000 | — | 4.0 | 12.4 | 5.6 | 0.09 | 565 | 692 |
| 9 | 790 | 34,000 | — | 4.5 | 12.1 | 4.7 | 0.13 | 592 | 730 |

*At an induction of 1 kGauss and a frequency of 5 kHz.

TABLE VIII

| Magnetic Properties of $Fe_{76-y}Ni_yMo_4C_{18}B_2$, Annealed | | | | | |
|---|---|---|---|---|---|
| Value of "y" | dc Permeability Initial (50) | dc Permeability Maximum | ac Core Loss**, watt/kg | Remanence, kGauss | Coercive Force, Oe |
| 0 | 3,140 | 114,000 | — | 5.3 | 0.05 |
| 3 | 1,850 | 92,000 | — | 5.6 | 0.06 |
| 9 | 1,730 | 82,000 | 0.7 | 5.0 | 0.06 |

*Heated to 600 K for 2 hr in 10 Oe.
**At an induction of 1 kGauss and a freqency of 5 kHz.

Example 5: Fe-M-B System

Ribbons having compositions given by $Fe_{80-x}M_xB_{20}$, where M is an element selected from the group consisting of titanium, niobium and tungsten were prepared. The ribbons, having dimensions of about 1 to 2 mm wide and about 25 to 50 μm thick were formed as in Example 1. The content of titanium, niobium and tungsten was varied from 0 ($Fe_{80}B_{20}$) to 5 atom percent. Substantially glassy ribbons were obtained. The magnetic and thermal data are summarized in Table IX below.

Table IX

| Magnetic and Thermal Properties of $Fe_{8-x}M_xB_{20}$, As-quenched | | | | |
|---|---|---|---|---|
| Value of "x" | M | Saturation Magnetization, kGauss | Curie Temperature, K. | Crystallization Temperature, K. |
| 0 | — | 16.0 | 647 | 658 |
| 5 | Ti | 13.0 | 546 | 745 |
| 5 | Nb | 10.3 | 482 | 795 |
| 5 | W | 9.4 | 497 | 810 |

What is claimed is:

1. A metallic glass that is substantially completely glassy having a combination of high permeability, low magnetostriction, low ac core loss and high thermal stability consisting of (a) about 53 to 83 atom percent iron and 0 to about 10 atom percent cobalt, the total of iron and cobalt in the metal alloy ranging from about 63 to 83 atom percent, up to about 60% of the total of which metal may be replaced with nickel, (b) about 2 to 12 atom percent of at least one element selected from the group consisting of molybdenum, tungsten, niobium and titanium and (c) about 15 to 25 atom percent of a metalloid selected from the group consisting of substantially boron only, substantially phosphorus only and carbon plus boron plus incidental impurities.

2. The metallic glass of claim 1 in which the metalloid content ranges from about 17 to 20 atom percent.

3. The metallic glass of claim 2 having the nominal composition $Fe_{81}Mo_2B_{17}$.

4. The metallic glass of claim 1 consisting of about 70 to 78 atom percent of at least one metal selected from the group of iron and iron plus cobalt, about 2 to 10 atom percent molybdenum and about 20 atom percent boron.

5. The metallic glass of claim 4 consisting of about 70 to 78 atom percent iron, about 2 to 10 atom percent molybdenum and about 20 atom percent boron.

6. The metallic glass of claim 5 consisting of about 74 to 78 atom percent iron, about 2 to 6 atom percent molybdenum and about 20 atom percent boron.

7. The metallic glass of claim 6 selected from the group of nominal compositions consisting of $Fe_{78}Mo_2B_{20}$ and $Fe_{76}Mo_4B_{20}$.

8. The metallic glass of claim 1 consisting of about 68 to 78 atom percent iron, up to about 60% of which is replaced with nickel, about 2 to 12 atom percent molybdenum and about 20 atom percent boron.

9. The metallic glass of claim 8 consisting of about 40 atom percent iron, about 28 to 38 atom percent nickel, about 2 to 12 atom percent molybdenum and about 20 atom percent boron.

10. The metallic glass of claim 9 consisting of about 40 atom percent iron, about 34 to 38 atom percent nickel, about 2 to 6 atom percent molybdenum and about 20 atom percent boron.

11. The metallic glass of claim 10 having the nominal composition $Fe_{40}Ni_{36}Mo_4B_{20}$.

12. The metallic glass of claim 1 consisting of about 68 to 76 atom percent of at least one metal selected from the group consisting of iron and iron plus cobalt, about 4 to 12 atom percent molybdenum, about 16 atom percent carbon and about 2 atom percent boron.

13. The metallic glass of claim 12 having the nominal composition $Fe_{70}Co_6Mo_4C_{18}B_2$.

14. The metallic glass of claim 12 consisting of about 68 to 76 atom percent iron, about 4 to 12 atom percent molybdenum, about 18 atom percent carbon and about 2 atom percent boron.

15. The metallic glass of claim 14 consisting of about 72 to 76 atom percent iron, about 4 to 8 atom percent molybdenum, about 18 atom percent carbon and about 2 atom percent boron.

16. The metallic glass of claim 15 having the nominal composition $Fe_{72}Mo_8C_{18}B_2$.

17. The metallic glass of claim 1 consisting of about 68 to 76 atom percent iron, up to about 60% of which is replaced with nickel, about 4 to 12 atom percent molybdenum, about 18 atom percent carbon and about 2 atom percent boron.

18. The metallic glass of claim 17 consisting of about 67 to 76 atom percent iron, 0 to about 9 atom percent nickel, about 4 atom percent molybdenum, about 18 atom percent carbon and about 2 atom percent boron.

19. The metallic glass of claim 18 having the nominal composition $Fe_{72}Ni_6Mo_4C_{18}B_2$.

20. The metallic glass of claim 1 consisting of about 75 to 78 atom percent iron, about 2 to 5 atom percent of at least one element selected from the group consisting of tungsten, niobium and titanium and about 20 atom percent boron.

* * * * *